US007294607B2

(12) United States Patent
Godici et al.

(10) Patent No.: US 7,294,607 B2
(45) Date of Patent: Nov. 13, 2007

(54) SYNERGISTIC COMBINATION OF LOAD SUPPLEMENT ADDITIVE AND CORROSION INHIBITORS FOR LUBRICANT COMPOSITIONS

(75) Inventors: Patrick E. Godici, Naperville, IL (US); David G. V. Jones, Wheaton, IL (US); Kim E. Fyfe, Sarnia (CA)

(73) Assignee: BP Corporation North America Inc., Warrenville, IL (US)

( * ) Notice: Subject to any disclaimer, the term of this patent is extended or adjusted under 35 U.S.C. 154(b) by 345 days.

(21) Appl. No.: 10/645,266

(22) Filed: Aug. 21, 2003

(65) Prior Publication Data

US 2004/0072701 A1 Apr. 15, 2004

Related U.S. Application Data

(60) Provisional application No. 60/405,148, filed on Aug. 21, 2002.

(51) Int. Cl.
*C10M 169/04* (2006.01)
*C10M 105/38* (2006.01)
*C10M 137/10* (2006.01)

(52) U.S. Cl. ..... 508/282; 508/485; 508/224

(58) Field of Classification Search ..... 508/280, 508/282, 430, 485, 224
See application file for complete search history.

(56) References Cited

U.S. PATENT DOCUMENTS 3,429,813 A 2/1969 Waight et al. ..... 252/46.7
3,931,022 A * 1/1976 Chesluk et al. ..... 508/210
5,503,761 A * 4/1996 Ashcraft et al. ..... 508/485
5,856,280 A * 1/1999 Kim et al. ..... 508/509
5,922,657 A * 7/1999 Camenzind et al. ..... 508/430
6,348,440 B1 * 2/2002 Meskers et al. ..... 510/253

FOREIGN PATENT DOCUMENTS

WO WO 02/053687 * 7/2002
WO WO02053687 A 7/2002

* cited by examiner

*Primary Examiner*—Vasu Jagannathan
*Assistant Examiner*—Jim Goloboy
(74) *Attorney, Agent, or Firm*—Jennifer M. Hall; Mary Jo Kanady; Stephen L. Hensley

(57) ABSTRACT

The present invention relates to a lubricant composition exhibiting enhanced load-carrying capacity and oxidative/corrosion stability. The lubricant composition of the present invention comprises a major portion of an aliphatic ester base oil having lubrication properties and formed by the reaction of pentaerythritol and an organic carboxylic acid. The lubricant composition further comprises 3-(di-isobutoxy-thiophosphonylsulfanyl)-2-methyl-propionic acid (DITMPA) as an additive comprising from about 0.01 to about 0.40 weight percent of the fully formulated lubricating oil composition as well as yellow metal passivator comprising from about 0.01 to about 0.40 weight percent of the fully formulated lubricating oil composition. The enhanced load-carrying capacity and oxidative/corrosion stability of lubricant compositions containing DITMPA and yellow metal passivator is achieved without deleteriously affecting other salient properties of the lubricant.

6 Claims, No Drawings

SYNERGISTIC COMBINATION OF LOAD SUPPLEMENT ADDITIVE AND CORROSION INHIBITORS FOR LUBRICANT COMPOSITIONS

RELATED APPLICATIONS

This application claims the benefit under 35 U.S.C. §119(e) of U.S. Provisional Application No. 60/405,148 ("the '148 application") filed on Aug. 21, 2002. The '148 application is incorporated by reference in this specification.

FIELD OF THE INVENTION

This invention generally relates to ester-based, in particular diester and polyol ester-based, lubricant compsotions which exhibit superior load-carrying capability and oxidative stability. More particularly, it is related to turbine oils comprising esters of pentaerythritol with fatty acids as base oil stocks further comprising the use of a yellow metal passivator, such as tolutriazole or benzotrizole, and 3-(di-isobutoxy-thiophosphonylsulfanyl)-2-methyl-propionic acid (henceforth referred to as DITMPA) to enhance load-carrying, oxidative capacity and corrosion/oxidative stability of the turbine oils without negatively impacting other salient properties of the turbine oil.

BACKGROUND OF THE INVENTION

In order to meet government and military specifications, turbine oil compositions must score well on a number of standard tests including those that measure the capacity of the turbine oil's load-carrying ability. Additives, such as amine phosphates, alkylthiosuccinic acids, thiphene carboxylic acid derivatives, and other sulfur-containing compounds have been used to improve the load-carrying capacity of ester base turbine oils.

Ester base lubricating oil compositions prepared from pentaerythritol and a mixture of fatty acids and containing selected additives, such as those recited above for improvement in load-carrying capacity, are well known and have been somewhat successful in increasing the turbine oil's load-carrying ability. However, deleterious effects on other desirable features often accompany the improvement in load-carrying ability of these modified turbine oils. In particular, the score of these oils in industry standard tests that measure deposit formation under simulated wear tends to deteriorate. There is a continuing need for additives that improve the load-carrying capacity of turbine oils without deleteriously affecting other salient properties of the turbine oil such as oxidative stability, viscosity and TAN increase. This invention addresses that continuing need.

SUMMARY OF THE INVENTION

The present invention resides in a lubricant composition exhibiting enhanced load-carrying capacity and oxidative/corrosion stability and to a method for achieving that result in turbine oils and attainment of these benefits without deleteriously affecting the other salient features of the turbine oil.

Load additives of various chemistries, particularly those comprised of sulfur and/or phosphorous, are typically used when formulating turbine oils with enhanced load properties. Inclusion of a load additive in a formulation typically leads to increased copper loss in an oxidizing environment. Thus, typically there is a trade off between enhanced load capacity and copper corrosion. However, the present invention is directed to a unique formulation of additives that results in a turbine oil composition having enhanced load-carrying capacity and enhanced copper and oxidative stability.

The lubricant composition of the present invention comprises a major proportion of synthetic polyol ester based base stock, including diesters and polyol esters, preferably polyol ester based base stock and a minor proportion of DITMPA high load-carrying additive and a yellow metal passivator. Other, conventional additives such as extreme pressure, pour point reduction, oxidative stability, antifoaming, hydrolytic stability, improved viscosity index performance, anti-wear, and corrosion inhibitor additives and others may also be simultaneously employed, including other load-carrying additives.

The synthetic polyol ester based base stock comprises the major portion of the fully formulated synthetic ester based lubricating oil composition. In general, the ester base fluid is present in concentrations of over 90 percent by weight of the composition and typically is present in concentrations of over 95 percent by weight.

It should be noted that the term "comprising" is used frequently throughout the description of this invention and also in the appended claims. "comprising", as used in this application and the appended claims is defined as "specifying the presence of stated features, integers, steps, or components as recited, but not precluding the presence or addition of one or more other steps, components, or groups thereof". Comprising is different from "consisting of", which does preclude the presence or addition of one or more other steps, components, or groups thereof.

DETAILED DESCRIPTION OF THE INVENTION

A lubricant composition having both unexpectedly superior high load-carrying capacity and superior copper passivation comprises a major portion of a synthetic ester base oil and minor portion of DITMPA and a yellow metal passivator such as benzotriazole and tolutriazole which is also known as methyl benzotriazole. Surprisingly, it has been found that a lubricant composition with a reduced amount of tricresyl phosphate (TCP) load/antiwear additive, a reduced amount of a yellow metal passivator such as tolutriazole or benzotriazole and a minor amount of DITMPA provides enhanced load carrying capability, enhanced copper passivation, and improved oxidation/corrosion stability.

The synthetic polyol ester base oil is formed by the esterification of an aliphatic polyol with carboxylic acid. The aliphatic polyol contains from 4 to 15 carbon atoms and has from 2 to 8 esterifiable hydroxyl groups. Examples of polyol are trimethylolpropane, pentaerythritol, dipentaerythritol, neopentyl glycol, tripentaerythritol and mixtures thereof.

The carboxylic acid reactant used to produce the synthetic polyol ester base oil is selected from aliphatic monocarboxylic acid or a mixture of aliphatic monocarboxylic acid and aliphatic dicarboxylic acid. The carboxylic acid contains from 4 to 12 carbon atoms and includes the straight and branched chain aliphatic acids. Mixtures of carboxylic acids may be used.

The preferred polyol ester base oil is one prepared from technical pentaerythritol and a mixture of $C_4$-$C_{12}$ carboxylic acids. Technical pentaerythritol is a mixture that includes about 85 to 92 wt % monopentaerythritol and 8 to 15 wt % dipentaerythritol. A typical commercial technical pentaerythritol contains about 88 wt % monopentaerythritol having Formula 1 and about 12 wt % of dipentaerythritol having Formula 2.

Formula 1

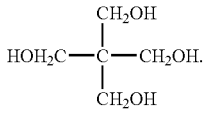

Formula 2

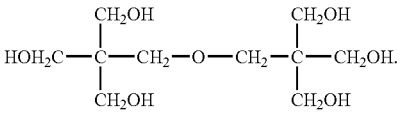

The technical pentaerythritol may also contain some tri and tetra pentaerythritol which are typically formed as by-products during the production of technical pentaerythritol.

The preparation of esters from alcohols and carboxylic acids can be accomplished using conventional methods and techniques known and familiar to those skilled in the art, and form no part, per se, of the present invention. In general, technical pentaertythritol is heated with the desired carboxylic acid mixture, optionally in the presence of a catalyst. Generally, a slight excess of acid is employed to force the reaction to completion. Water is removed during the reaction and any excess acid is then stripped from the reaction mixture. The esters of technical pentaerythritol may be used without further purification or may be further purified using conventional techniques such as distillation.

For the purposes of this specification and the appended claims, the term "technical pentaerythritol ester" is understood as meaning the polyol ester base oil prepared from technical pentaerythritol and a mixture of $C_4$-$C_{12}$ carboxylic acids.

The lubricant composition of the present invention preferably has at least one of the following uses: crankcase engine oils, two-cycle engine oils, catapult oils, hydraulic fluids, drilling fluids, turbine oils (e.g., aircraft turbine oils), greases, compressor oils, gear oils and functional fluids. Preferably, the lubricant composition of the present invention is used in an aero-derived, gas turbine engines (e.g., jet turbine engines, marine engines, and power generating applications).

The lubricant compositions of the present invention may also comprise other conventional lubricant additives. Lubricating oil additives are described generally in "Lubricants and Related Products" by Dieter Klamann, Verlag Chemie, Deerfield, Fla., 1984, and also in "Lubricant Additives" by C. V. Smalheer and R. Kennedy Smith, 1967, pp. 1-11, the contents of which are incorporated herein by reference. Lubricating oil additives are also described in U.S. Pat. Nos. 6,043,199, 5,856,280, and 5,698,502, the contents of which are incorporated herein by reference.

The lubricant composition according to the present invention preferably comprises about 85, 86, 87, 88, 89, 90, 91, 92, 93, 94, 95, 96, 97, 98, 99.9 wt % by weight of the mixed polyol ester composition of the present invention and about 0.1, 0.5, 1.0, 1.5, 2.0, 2.5, 3.0, 3.5, 4.0, 4.5, 5.0, 5.5, 6.0, 6.5, 7.0, 7.5, 8.0, 8.5, 9.0, 9.5, 10.0, 10.5, 11.0, 11.5, 12.0, 12.5, 13.0, 13.5, 14.0, 14.5 to 15 wt %, preferably 2 to 10 wt %, most preferably 3 to 8 wt % by weight of a lubricant additive package.

The lubricant composition of the present invention may also contain any of the other typical additives which are usually or preferably present in such fully formulated products except where as it has been otherwise indicated below. Thus, a fully formulated turbine oil may contain one or more of the following classes of additives: antioxidants, antiwear agents, extreme pressure additives, antifoamants, detergents, hydrolytic stabilizers, metal deactivators, other rust inhibitors, etc. Total amounts of such other additives can be in the range 0.5 to 15 wt % preferably 2 to 10 wt %, most preferably 3 to 8 wt %.

Antioxidants, which can be used, include aryl amines, e.g. phenylnaphthylamines and dialkyl diphenylamines, mixtures thereof and reaction products thereof which are described in U.S. Pat. No. 6,426,324 the contents of which are incorporated herein by reference; hindered phenols, phenothiazines, and their derivatives. The antioxidants are typically used in an amount in the range 1 to 5 wt %.

Antiwear/extreme pressure additives include hydrocarbyl phosphate esters, particularly trihydrocarbyl phosphate esters in which the hydrocarbyl radical is an aryl or alkaryl radical or mixture thereof. Particular antiwear/extreme pressure additives include tricresyl phosphate, triaryl phosphate and mixtures thereof. Other or additional anti wear/extreme pressure additives may also be used. The antiwear/extreme pressure additives are typically used in an amount in the range 0 to 4 wt %, preferably 1 to 3 wt %.

Industry standard corrosive inhibitors may also be included in the turbo oil. Such known corrosion inhibitors include the various triazols, for example, tolyltriazol, 1,2,4 benzotriazol, 1,2,3 benzotriazol, carboxy benzotriazole, allylated benzotriazol. The standard corrosion inhibitor additive can be used in an amount in the range 0.02 to 0.5 wt %, preferably 0.05 to 0.25 wt %. Other rust inhibitors common to the industry include the various hydrocarbyl amine phosphates and/or amine phosphates.

Foam control can be provided by many compounds including an antifoamant of the polysiloxane type, e.g., silicone oil or polydimethyl siloxane.

Another additive that can be used is an anti-deposition and oxidative additive. A typical anti-deposition and oxidation additive is a sulfur containing carboxylic acid (SCCA) as described in U.S. Pat. No. 5,856,280. The SCCA derivative is used in an amount in the range 100 to 2000 ppm, preferably 200 to 1000 ppm, most preferably 300 to 600 ppm.

As previously indicated, other additives can also be employed including hydrolytic stabilizers pour point depressants, anti foaming agents, viscosity and viscosity index improver, etc.

The individual additives may be incorporated into the present lubricant composition in any convenient way. Thus, each of the components can be added directly to the base stock by dispersing or dissolving it in the base stock at the desired level of concentration. Such blending may occur at ambient temperature or at an elevated temperature. Preferably, all the additives except for the viscosity modifier and the pour point depressant are blended into a concentrate or additive package, which is subsequently blended into base stock to make finished lubricant. Use of such concentrates in this manner is conventional. The concentrate will typically be formulated to contain the additive(s) in proper amounts to provide the desired concentration in the final formulation when the concentrate is combined with a predetermined amount of base lubricant. The concentrate is preferably made in accordance with the method described in U.S. Pat. No. 4,938,880, the contents of which are incorporated herein by reference. That patent describes making a pre-mix of ashless dispersant and metal detergents that is pre-blended at a temperature of at least about 100° C. Thereafter, the pre-mix is cooled to at least 85° C. and the additional components are added.

As previously stated, to a partially formulated polyol ester base stock, with additives that include antioxidants, corrosion inhibitors and hydrolytic stabilizers, is added a minor portion of DITMPA, TCP and yellow metal passivator such that the DITMPA generally comprises from about 0.01 to about 0.40 weight percent, and the yellow metal passivator comprises from about 0.01 to about 0.40 weight percent, of the fully formulated lubricating oil composition.

The structure of the DITMPA additive is as shown below. Formula 3.

3-(di-isobutoxy-thiophosphonylsulfanyl)-2-methyl-propionic acid (DITMPA)

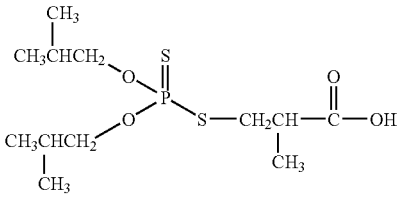

More particularly, the DITMPA comprises from about 0.02 to about 0.20 weight percent of the fully formulated lubricating oil composition, for example from about 0.03 to about 0.10 weight percent of the fully formulated lubricating oil composition. The DITMPA may be mixed or blended with the polyol ester base stock by any convenient and known means. If desirable, concentrates may be prepared for subsequent dilution with additional polyol ester base prior to deployment.

The yellow metal passivator can be selected from the general class of such additives which includes, but is not limited to, benzotriazole, quinizarin and tolutriazole also known as methyl benzotriazole. For example, the yellow metal passivator can be tolutriazole and comprises from about 0.05 to about 0.1 weight percent of the fully formulated lubricating oil composition. With the addition of DITMPA, the weight percent of other load carrying additives such as TCP can be reduced while still retaining enhanced load-carrying capacity and enhanced copper passivation.

EXAMPLES

Severe FZG FLS Test

It will be shown by the following Examples 1-7 that addition of DITMPA to a formulated turbine oil lubricant composition will serve to enhance the performance in load-carrying capacity standard tests and cause the additive-containing turbine oil to score higher on the tests. A characterization of Examples 1-7 follows.

All of the Examples, with the exception of Example 7 which is a competitor's fully formulated turbine oil, begin with an identical Technical Pentaerythritol base stock partially formulated with additives that include antioxidants, corrosion inhibitors and hydrolytic stabilizers. ("Base Turbine Oil")

Example 1 is the Base Turbine Oil containing among other additives 0.094 weight percent tolutriazole (TT) and 1.877 weight percent tricresyl phosphate (TCP). TCP is a known load/anti-wear supplement additive for aviation turbine oils and TT is a corrosion inhibitor/copper passivator for aviation turbine oils.

Example 2 is the Base Turbine Oil of Example 1 with reduced amounts of TCP and TT additives (0.066 weight percent TT and 1.064 weight percent TCP) to which has been added DITMPA such that the DITMPA comprises 0.052 weight percent of the fully formulated composition of Example 2.

Example 3 is the Base Turbine Oil of Example 2 except that the DITMPA comprises 0.104 weight percent of the fully formulated composition of Example 3.

Example 4 is the same as Example 2, where the DITMPA is substituted with a Sulfur containing Di-Mercaptothiodiazole (DMTD) derivative, such that the DMTD comprises 0.095 weight percent of the fully formulated composition of Example 4. DMTD is a known sulfur-containing load carrying additive for aviation turbine oils.

Example 5 is the same as Example 2, where the DITMPA is substituted with a Sulfurized Fatty Acid Ester (SFAE), such that the SFAE comprises 0.0047 weight percent of the fully formulated composition of Example 5. SFAE is a known sulfur-containing load carrying additive for aviation turbine oils.

Example 6 is the same as Example 5, but the SFAE comprises 0.095 weight percent of the fully formulated composition of Example 6.

Example 7 is a competitive high load HTS turbine oil qualified to the same U.S. Military specification as Example 1.

The DITMPA used for Examples 2 and 3 was obtained from Ciba Specialty Chemicals and used as delivered from this supplier. The DMTD was obtained from R.T. Vanderbilt Company as CUVAN 826 and was used as delivered from the supplier. The SFAE was obtained from King Industries as NA-Lube EP 5210 and was used as delivered from the supplier. Examples 1-7 were then subjected to a series of standard tests. The purpose was to show that Examples 2 and 3, comprising the DITMPA, out performed the load-carrying capability of the TCP enhanced base turbine oil of Example 1.

The load-carrying capacity of the turbine oil compositions of Examples 1-7 was evaluated in the severe FZG gear test. The FZG gear test is an industry standard test to measure the ability of an oil to prevent scuffing of a set of moving gears as the load applied to the gears is increased. The "severe" FZG test mentioned here is distinguished from the FZG test standardized in DIN 51 354 for gear oils in that the test oil is heated to a higher temperature (140° C. versus 90° C.), the test is run at 3000 rpm versus 1500 rpm, and the maximum pitch line velocity of the gear is also higher (16.6 versus 8.3 m/s). The FZG performance is reported in terms of failure load stage (FLS), which is defined by a lowest load state at which the sum of widths of all damaged areas exceed one tooth width of the gear. The results of the severe FZG test for Examples 1-3 are given in Table 1.

TABLE 1

| Example Number | 1 | 2 | 3 | 4 | 5 | 6 | 7 |
|---|---|---|---|---|---|---|---|
| DITMPA, % wt | 0 | 0.052 | 0.104 | — | — | — | U/K |
| TT, % Wt | 0.094 | 0.066 | 0.066 | 0.066 | 0.066 | 0.07 | U/K |
| TCP, % Wt | 1.877 | 1.064 | 1.064 | 1.064 | 1.064 | 1.064 | U/K |
| DMTD, % Wt | — | — | — | 0.095 | — | — | U/K |

TABLE 1-continued

| Example Number | 1 | 2 | 3 | 4 | 5 | 6 | 7 |
|---|---|---|---|---|---|---|---|
| SFAE, % Wt | — | — | — | — | 0.047 | 0.095 | U/K |
| Severe FZG FLS | 4.0 | 7.0 | 8.0 | 6.0 | Not tested | 5.0 | 9.0 |

U/K = Unknown

From the results given in Table 1, it can be seen that the load-carrying capacity of a Base Turbine Oil enhanced with 1.877 weight percent TCP as the load-carrying additive (Example 1) is exceeded by a Base Turbine Oils containing reduced amounts TCP, reduced amounts of TT and low levels of DITMPA. It can also be seen from Examples 4 and 6 that this effect cannot be achieved with any sulfur containing load additive, but is unique to the addition of DITMPA. These results show greater load values than can be achieved with TCP alone.

Oxidation Corrosion Stability Test

Examples 1 through 7 were also subject to an internal oxidation corrosion stability (OCS) credit/debit assessment based on the Data presented in Table 3. The results were as follows:

TABLE 2

| Example Number | 1 | 2 | 3 | 4 | 5 | 6 | 7 |
|---|---|---|---|---|---|---|---|
| Copper weight loss | S | C | C | D | C | C | D |
| TAN Change | S | S | S | D | D | D | D |
| Visc. Change | S | C | C | S | C | C | D |

S = Example 1 Performance Level;
C = Performance credit compared to Example 1
D = Performance deficit compared to Example 1.

This test shows that Examples 2 and 3 are the only two that perform well on both the severe FZG load test and on the Oxidation Corrosion Stability test.

In order to further demonstrate the synergistic effect of DITMPA and TT on corrosion stability, additional tests (Examples 8-15) were conducted to vary the three key additive components—TCP, TT and DITMPA—and their effect on performance in OCS tests. The OCS test was conducted on the aviation turbine oils in accordance with ASTM Method D4636-99 at 400° F. and 425° F. to determine their resistance to oxidation and corrosion degradation and their tendency to corrode various metals such as copper. In accordance with the ASTM test method, square metal specimens of Copper, Steel, Aluminum, Magnesium and Silver were tied together in a specified configuration, then immersed in 100 ml of the test lubricant within a large glass test tube. The tube was maintained at the test temperature, namely 400° F. and 425° F. for 72 hours. 5 Liters per Hour of Air was blown through the test oil for the duration of the test. At the end of the test the metal specimens were assessed for weight change and the oil was assessed for Viscosity and Acidity increase. The composition of the test lubricant Examples 8-15 were:

Example 8 is the turbine oil of Example 2 except that the TT comprises 0.038 weight percent of the fully formulated composition of Example 8.

Example 9 is the turbine oil of Example 2 except that the TT comprises 0.095 weight percent of the fully formulated composition of Example 9.

Example 10 is the turbine oil of Example 2 except that the DITMPA comprises 0.028 weight percent of the fully formulated composition of Example 10.

Example 11 is the turbine oil of Example 2 except that the DITMPA is not present.

Example 12 is the turbine oil of Example 2 except that the DITMPA is not present and the corrosion inhibitor/copper passivator TT comprises 0.095 weight percent of the fully formulated composition of Example 12.

Example 13 is the turbine oil of Example 2 except that the DITMPA is not present and the corrosion inhibitor/copper passivator TT comprises 0.038 weight percent of the fully formulated composition of Example 13.

Example 14 is the turbine oil of Example 2 except that the corrosion inhibitor/copper passivator TT is not present.

Example 15 is the turbine oil of Example 2 except that the DITMPA and TT are not present.

The results of the test are shown in Table 3.

TABLE 3

| Example No. | 1 | 2 | 3 | 4 | 5 | 6 | 7 |
|---|---|---|---|---|---|---|---|
| DITMPA % wt | 0 | 0.052 | 0.104 | 0.095 DMTD | 0.047 SFAE | 0.095 SFAE | U/K |
| TT % wt | 0.094 | 0.066 | 0.066 | 0.066 | 0.066 | 0.066 | U/K |
| TCP % wt | 1.877 | 1.064 | 1.064 | 1.064 | 1.064 | 1.064 | U/K |
| 400° F. Cu wt loss mg/cm2 | −0.082 | −0.055 | −0.11 | −0.705 | −0.08 | −0.075 | −0.28 |
| 400° F. Delta Visc | 11.72 | 9.02 | 9.44 | 12.18 | 11.285 | 10.52 | 17.68 |
| 400° F. Delta TAN | 1.04 | 0.36 | 0.41 | 0.845 | 0.90 | 0.705 | 2.93 |
| 425° F. Cu wt loss mg/cm2 | −0.36 | −0.11 | −0.22 | −0.88 | −0.38 | −0.31 | −0.54 |
| 425° F. Delta Visc | 32.83 | 18.99 | 18.98 | 19.64 | 20.5 | 19.83 | 38.98 |
| 425° F. Delta TAN | 2.78 | 2.55 | 1.76 | 8.42 | 12.1 | 7.68 | 5.47 |

| Example No. | 8 | 9 | 10 | 11 | 12 | 13 | 14 | 15 |
|---|---|---|---|---|---|---|---|---|
| DITMPA % wt | 0.052 | 0.052 | 0.028 | 0 | 0 | 0 | 0.052 | 0 |
| TT % wt | 0.038 | 0.095 | 0.066 | 0.066 | 0.095 | 0.038 | 0 | 0 |
| TCP % wt | 1.064 | 1.064 | 1.064 | 1.064 | 1.064 | 1.064 | 1.064 | 1.064 |
| 400° F. Cu wt loss mg/cm2 | −0.085 | −0.047 | −0.047 | −0.078 | −0.078 | −0.093 | −0.434 | −0.372 |
| 400° F. Delta Visc | 9.12 | 10.18 | 10.97 | 12.9 | 12.37 | 13.41 | 12.98 | 17.95 |
| 400° F. Delta TAN | 0.54 | 0.46 | 0.46 | 1.22 | 0.89 | 1.25 | 0.63 | 1.19 |

TABLE 3-continued

| | | | | | | | | |
|---|---|---|---|---|---|---|---|---|
| 425° F. Cu wt loss mg/cm2 | −0.085 | −0.116 | −0.124 | −0.364 | −0.411 | −0.395 | −2.0 | −2.078 |
| 425° F. Delta Visc | 18.99 | 20.26 | 23.34 | 42.98 | 36.55 | 42.83 | 34.83 | 47.41 |
| 425° F. Delta TAN | 2.42 | 3.1 | 2.49 | 3.26 | 5.7 | 2.62 | 2.3 | 3.23 |

The results demonstrate the benefit of having both DITMPA and TT in the same formula as that combination offers both increased load performance as well as reduced copper weight loss. This result is unexpected as TT is a copper passivator and one would expect the copper weight loss to increase as the weight percent of TT decreased. However, the addition of DITMPA and TT provides better load values as well as reduced copper corrosion. Only the Examples that contain both DITMPA and TT—Examples 2, 3, 8, 9, and 10—provide synergistic copper corrosion and oxidative stability results. Examples 11-15 that lack one or the other additive, have three times the copper weight loss at 425° F. and double the change in viscosity at 425° F.

Hot Liquid Process Simulator (HLPS). Test Method: SAE ARP5996

The HLPS test method is designed to evaluate the coking propensity of synthetic ester-based aviation lubricants under single phase flow conditions found in certain parts of gas turbine engines, for instance in bearing feed tubes.

Examples 1, 2, 3 and 7 were subjected to the HLPS test which was conducted as follows: A measured volume of 100 mls amount sample was placed in the HLPS apparatus. The apparatus was pressurized with air to 200 psi and the sample was then pumped through the system over a resistance-heated, tube-in-shell, heat exchanger for a period of 20 and 40 hours at over a range of 300-350° C. degrees. The weight of deposit formed on the tube after each test was then recorded in milligrams and the average result achieved during the number of tests run is recorded in Table 4.

TABLE 4

| Example No. | No. of Tests | Wt (mg) after 20 Hr | Wt (mg) after 40 Hr |
|---|---|---|---|
| 1 | 33 | 0.19 | 0.33 |
| 2 | 5 | 0.17 | 0.34 |
| 3 | 3 | 0.28 | 0.58 |
| 7 | 5 | 0.35 | 0.66 |

US Navy Vapor Phase Coking Test

Examples 1, 2, 3 and 7 were subjected to the U.S. Navy Vapor Phase Coker Test (USNVPC). The purpose of this test is to determine the deposit-forming tendency of hot turbo oil vapors (air-oil mist) as they pass through a heated Coker tube. The weight of the deposits is measured in milligrams.

The USNVPC test consists of a three-neck flask (oil reservoir) surrounded by an electric heating mantle, an intermediate heater tube surrounded by a brass heat sink and two semi-cylindrical heating units, and a stainless steel coking tube on which the deposits are formed.

Air was fed through a tube entering one neck of the flask and was bubbled through the hot oil to create an air-oil mist. The oil-mist escapes through the center neck of the flask and passed into the heater tube. From the heater tube the vapors pass into the coking tube where deposits form.

The oil temperature was maintained at 400° F. (204° C.) and the heater tube at 650° F. to 750° F. for 18 hours, including one hour to reach test temperature and 17 hours of actual run time. Oil temperature was monitored by a thermocouple immersed in the oil through the third neck of the flask. A second thermocouple is located in the heater section to permit control of the heater tube temperature. A series of six thermocouples is attached to the Coker tube to monitor the temperature of the tube. For these Examples testing was performed at 650° F. and 700° F. and the deposit results are show in Table 5.

TABLE 5

| | | Wt of deposits in mgs. | |
|---|---|---|---|
| Example No | No. of Tests at 650° F./700 ° F. | 650 ° F. | 700 ° F. |
| 1 | 4/14 | 179 | 197 |
| 2 | 2/2 | 176 | 209 |
| 3 | 2/2 | 132 | 196 |
| 7 | 4/3 | 278 | 290 |

The results of this test demonstrate that the lubricant composition of the present invention perform as well as or better then commercially available aviation turbine oils in the Vapor Phase Coking Test while still providing enhanced load and oxidation stability.

Cyclic Coker Mister Test

The Coker Mister Test attempts to simulate the hot section of a jet engine bearing compartment. It evaluates the tendency of a synthetic aviation lubricant to form a vapor mist and liquid film deposits within the tested temperature, pressure and oil flow conditions over time.

The Coker Mister tube is a stainless steel tube cut lengthwise into top and bottom halves with an end plate at the end of the cylinder. The top half simulates a vapor phase coking environment, the bottom half simulates a liquid phase coking environment, and the end plate is a mixed environment. The Coker mister tube is inclined at a specified angle and heated to 520° F. and the oil sample is sprayed into the open end of the tube.

The cyclic test was run for 72 Hours with 95, 45-minute cycles. Each cycle consisted of 30 minutes of regulated oil and airflow spray at 520° F., followed by air and oil flow being turned off and the cylinder rapidly heated to 560° F. for 75 seconds. Then cylinder is allowed to cool back to 520° F. for the remainder of the cycle. Post test analysis included weighing deposits on the top, bottom halves of the cylinder and end plate; oxidative condition of oil via Viscosity and Acidity change and sediment formation. Sediment formation was measured via post test filtration of oil through 1.2 micron filter and recorded as grams of sediment per liter of used oil after test. The results of the Coker Mister Test are the average results of the number of test runs shown in Table 6.

TABLE 6

| Ex No. | No of Tests | Vapor phase_ Wt (gr) | Liquid phase_ Wt (gr) | End Plate Wt (gr) | Delta Viscosity | Final TAN | Filter g/l |
|---|---|---|---|---|---|---|---|
| 1 | 28 | 0.23 | 0.22 | 0.25 | 13.48% | 2.5 | 0.03 |
| 2 | 10 | 0.17 | 0.18 | 0.17 | 9.12% | 2.7 | 0.02 |
| 3 | 2 | 0.22 | 0.24 | 0.15 | 9.85% | 2.4 | 0.03 |
| 7 | 6 | 0.46 | 0.51 | 0.45 | 8.36% | 3.1 | 0.57 |

For all three tests, Examples 2 and 3, i.e., those whose composition comprised TT and DITMPA, the deposition tests were within the same range or better than for Example 1. These results serve to demonstrate that the increased load-carrying capacity of Examples 2 and 3 was achieved without deleteriously affecting its performance on the deposit tests.

Reasonable variation and modification are possible in the scope of the foregoing disclosure and the appended claims to this invention, the essence of which is that a turbine oil composition comprising from about 0.01 to about 0.40 weight percent of 3-(di-isobutoxy-thiophosphonylsulfanyl)-2-methyl-propionic acid and from about 0.01 to about 0.40 weight percent of corrosion inhibitor such as tolutriazole or benzotriazole provides superior performance, in terms of load-carrying capacity and oxidation stability, to lubricating compositions such as turbine oils without deleteriously affecting deposition test performance.

We claim:

1. An aviation turbine oil lubricant composition exhibiting enhanced load-carrying capacity and oxidative/corrosion stability said lubricant composition comprising a major portion of:

a) a synthetic ester based base stock which is the esterification product of an aliphatic polyol containing 4 to 15 carbon atoms and from 2 to 8 esterifiable hydroxyl groups reacted with a carboxylic acid containing 4 to 12 carbon atoms;

and a minor portion of:

b) 3-(di-isobutoxy-thiophosphonylsulfanyl)-2-methyl-propionic acid (DITMPA); and c) tolutriazole wherein the DITMPA comprises from about 0.03 to about 0.10 weight percent of the fully formulated lubricating oil composition and the tolutriazole comprises from about 0.05 to about 0.10 weight percent of the fully formulated lubricating oil composition.

2. The composition of claim 1 wherein the synthetic ester stock is the esterification product of technical pentaerythritol and a mixture of $C_4$ to $C_{12}$ carboxylic acids.

3. A method for enhancing the load-carrying capacity and the oxidative/corrosion stability of a synthetic ester base stock aviation turbine oil lubricant composition oil by adding to said lubricant an additive comprising DITMPA and tolutriazole wherein the total weight of the DITMPA comprises from about 0.03 to about 0.10 weight percent of the fully formulated lubricating oil composition and the total weight of the tolutriazole comprises from about 0.05 to about 0.10 weight percent of the fully formulated lubricating oil composition.

4. The method of claim 3 wherein the synthetic ester based turbine oil stock is the esterification product of an aliphatic polyol containing 4 to 15 carbon atoms and from 2 to 8 esterifiable hydroxyl groups reacted with a carboxylic acid containing from 4 to 12 carbon atoms.

5. The method of claim 3 wherein the synthetic ester based turbine oil stock is the esterification product of technical pentaerythritol and a mixture of $C_4$ to $C_{12}$ carboxylic acids.

6. An aviation turbine oil lubricant composition exhibiting enhanced load-carrying capacity and oxidative/corrosion stability said lubricant composition comprising:

(a) a synthetic ester based stock which is the esterification product of technical pentaerythritol and a mixture of $C_4$ to $C_{12}$ carboxylic acids, (b) from about 0.03 to 0.10 weight percent 3-(di-isobutoxy-thiophosphonylsulfanyl)-2-methyl-propionic acid (DITMPA), and (c) from about 0.05 to 0.10 weight percent tolutriazole.

* * * * *